US005445206A

United States Patent [19]

Shepard

[11] Patent Number: 5,445,206

[45] Date of Patent: Aug. 29, 1995

[54] FLEXIBLE CLOSURES FORMED OF INTERLOCKING SEGMENTS

[76] Inventor: James M. Shepard, 2997 Avery Rd., St. Johns, Mich. 48879

[21] Appl. No.: 206,606

[22] Filed: Mar. 7, 1994

[51] Int. Cl.[6] ..... E05D 15/26

[52] U.S. Cl. ..... 160/201; 160/235

[58] Field of Search ..... 160/201, 235, 133, 206, 160/207, 208, 113, 118, 32

[56] References Cited

U.S. PATENT DOCUMENTS

| | | | |
|---|---|---|---|
| 3,056,451 | 10/1962 | Federline et al. | 160/201 |
| 3,118,702 | 1/1964 | Kale et al. | 160/235 X |
| 3,135,544 | 6/1964 | Mickey et al. | 160/201 X |
| 3,253,552 | 5/1966 | Stein | 160/40 X |
| 3,670,797 | 6/1972 | Sassano | 160/235 X |
| 3,798,839 | 3/1974 | Kaufman | 160/40 X |
| 4,128,120 | 12/1978 | Frey | 160/235 X |
| 4,379,479 | 4/1983 | Whiting | 160/201 |
| 4,432,591 | 2/1984 | Rinkewich | 160/235 X |
| 4,924,932 | 5/1990 | Esnault | 160/201 |

*Primary Examiner*—David M. Purol

[57] ABSTRACT

A flexible closure formed of interlocking segments comprising a plurality of segments which together constitute the closure, each of the segments located between facing recesses of rails to essentially fill the space between rails at the lower extents when in a closed operative orientation and to essentially fill the space between rails at the upper extents when in the inoperative storage orientation, each of the segments having an upper portion with a generally semi-circular cross-sectional configuration over the majority of its extent with the axis of the upper portion extending horizontally between the rails, each of the segments also having a lower portion in the lower part thereof with a recess being of a generally semi-circular configuration over the majority of its extent with its axis parallel with the axis of the upper portion, the upper portion of one segment being received within the recess of the lower portion of the next adjacent segment to thereby allow the flexing of the closure about the axes formed at the coupling between adjacent segments, the exterior surface of the lowermost segment being provided with a recessed portion for constituting a handle to open and close the closure.

1 Claim, 4 Drawing Sheets

FLEXIBLE CLOSURES FORMED OF INTERLOCKING SEGMENTS

BACKGROUND OF THE INVENTION

1. Field of the Invention

The present invention relates to flexible closures formed of interlocking segments slidable between a closed operative orientation and an out of the way stored orientation and more particularly pertains to sliding a flexible closure between a closed operative orientation to seal an opening and an out of the way storage orientation to open access through the opening.

2. Description of the Prior Art

The use of sliding closure devices is known in the prior art. More specifically, sliding closure devices heretofore devised and utilized for the purpose of opening and closing doors, windows and the like are known to consist basically of familiar, expected, and obvious structural configurations, notwithstanding the myriad of designs encompassed by the crowded prior art which has been developed for the fulfillment Of countless objectives and requirements.

The prior art discloses a large number of sliding closure devices. By way of example, U.S. Pat. No. 3,481,079 to Claes discloses sliding closures.

U.S. Pat. No. 3,613,199 to Duquette discloses a top roll assembly for spinning frames.

U.S. Pat. No. 4,016,920 to Shepard discloses a flexible guiding track and release mechanism for an overhead rolling door assembly.

U.S. Pat. No. 4,133,148 to Swenumson discloses a roll top garage.

U.S. Pat. No. 5,141,044 to Hying discloses a breakaway roll-up door.

Lastly, U.S. Pat. No. Des. 276,772 to Snediker discloses a roll-top cabinet.

In this respect, flexible closures formed of interlocking segments slidable between a closed operative orientation and an out of the way stored orientation according to the present invention substantially depart from the conventional concepts and designs of the prior art, and in doing so provide an apparatus primarily developed for the purpose of sliding a flexible closure between a closed operative orientation to seal an opening and an out of the way storage orientation to open access through the opening.

Therefore, it can be appreciated that there exists a continuing need for new and improved flexible closures formed of interlocking segments slidable between a closed operative orientation and an out of the way stored orientation which can be used for sliding a flexible closure between a closed operative orientation to seal an opening and an out of the way storage orientation to open access through the opening. In this regard, the present invention substantially fulfills this need.

SUMMARY OF THE INVENTION

In view of the foregoing disadvantages inherent in the known types of sliding closure devices now present in the prior art, the present invention provides improved flexible closures formed of interlocking segments slidable between a closed operative orientation and an out of the way stored orientation. As such, the general purpose of the present invention, which will be described subsequently in greater detail, is to provide new and improved flexible closures formed of interlocking segments slidable between a closed operative orientation and an out of the way stored orientation and methods which have all the advantages of the prior art and none of the disadvantages.

To attain this, the present invention essentially comprises a new and improved flexible closure formed of interlocking segments slidable between a closed operative orientation and an out of the way stored orientation comprising, in combination, a pair of rails extending parallel with each other in a vertical orientation at their lower extents and extending generally horizontal at their upper extents with curved extents between the upper and lower extents, the rails being formed with facing guide recesses; a plurality of segments which together constitute the closure, each of the segments located between the facing recesses of the rails to essentially fill the space between the rails at the lower extents when in a closed operative orientation and to essentially fill the space between the rails at the upper extents when in the inoperative storage orientation, each of the segments having an upper portion with a generally semi-circular cross-sectional configuration over the majority of its extent with the axis of the upper portion extending horizontally between the rails, each of the segments also having a lower portion in the lower part thereof with a recess being of a generally semi-circular configuration over the majority of its extent with its axis parallel with the axis of the upper portion, the upper portion of one segment being received within the recess of the lower portion of the next adjacent segment to thereby allow the flexing of the closure about the axes formed at the coupling between adjacent segments, the exterior surface of the lowermost segment being provided with a recessed portion for constituting a handle to open and close the closure; an aperture formed through each upper portion with a shaft extending therethrough with the ends of the shaft slidably recessed in the opposed recesses of the rails with a bearing assembly coupling each rail with its associated upper portion; and recesses extending generally perpendicular to the axes formed on the exterior surface of the segments above the lowermost segment for decorative purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved flexible closures formed of interlocking segments slidable between a closed operative orientation and an out of the way stored orientation which have all the advantages of the prior art sliding closure devices and none of the disadvantages.

It is another object of the present invention to provide new and improved flexible closures formed of interlocking segments slidable between a closed operative orientation and an out of the way stored orientation which may be easily and efficiently manufactured and marketed.

It is a further object of the present invention to provide new and improved flexible closures formed of interlocking segments slidable between a closed operative orientation and an out of the way stored orientation which are of a durable and reliable construction.

An even further object of the present invention is to provide new and improved flexible closures formed of interlocking segments slidable between a closed operative orientation and an out of the way stored orientation which are susceptible of a low cost of manufacture with regard to both materials and labor, and which accordingly are then susceptible of low prices of sale to the consuming public, thereby making such flexible closures formed of interlocking segments slidable between a closed operative orientation and an out of the way stored orientation economically available to the buying public.

Still yet another object of the present invention is to provide new and improved flexible closures formed of interlocking segments slidable between a closed operative orientation and an out of the way stored orientation which provide in the apparatuses and methods of the prior art some of the advantages thereof, while simultaneously overcoming some of the disadvantages normally associated therewith.

Even still another object of the present invention is to slide a flexible closure between a closed operative orientation to seal an opening and an out of the way storage orientation to open access through the opening.

Lastly, it is an object of the present invention to provide a flexible closure formed of interlocking segments comprising a plurality of segments which together constitute the closure, each of the segments located between facing recesses of rails to essentially fill the space between rails at the lower extents when in a closed operative orientation and to essentially fill the space between rails at the upper extents when in the inoperative storage orientation, each of the segments having an upper portion with a generally semi-circular cross-sectional configuration over the majority of its extent with the axis of the upper portion extending horizontally between the rails, each of the segments also having lower portion in the lower part thereof with a recess being of a generally semi-circular configuration over the majority of its extent with its axis parallel with the axis of the upper portion, the upper portion of one segment being received within the recess of the lower portion of the next adjacent segment to thereby allow the flexing of the closure about the axes formed at the coupling between adjacent segments, the exterior surface of the lowermost segment being provided with a recessed portion for constituting a handle to open and close the closure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

a perspective illustration of a rail for guiding the movement of the segments shown in the prior FIGS.

Figures 4, 5:
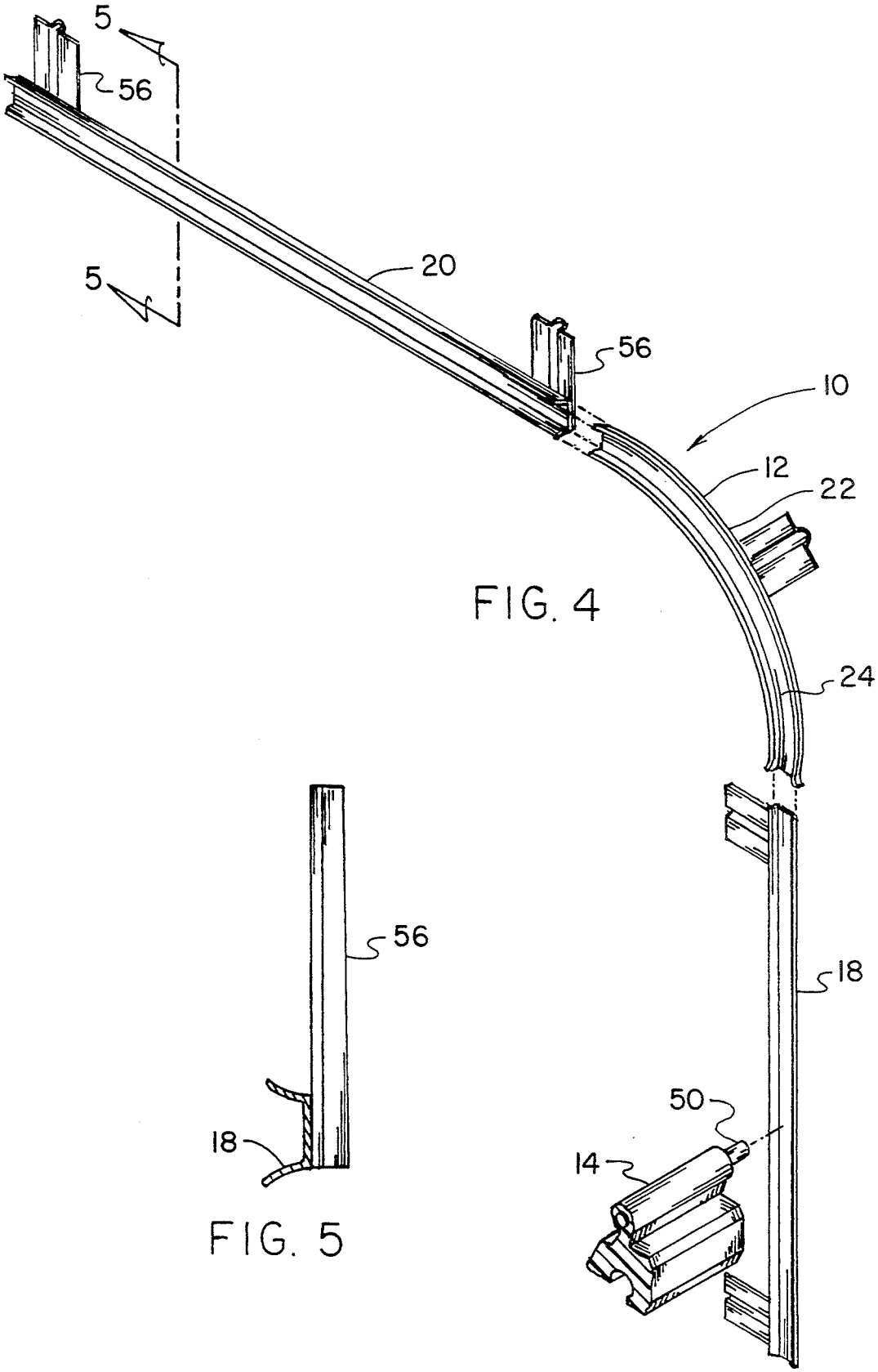

FIG. 5 is a cross-sectional view taken along line 5—5 of FIG. 4.

Figure 6:
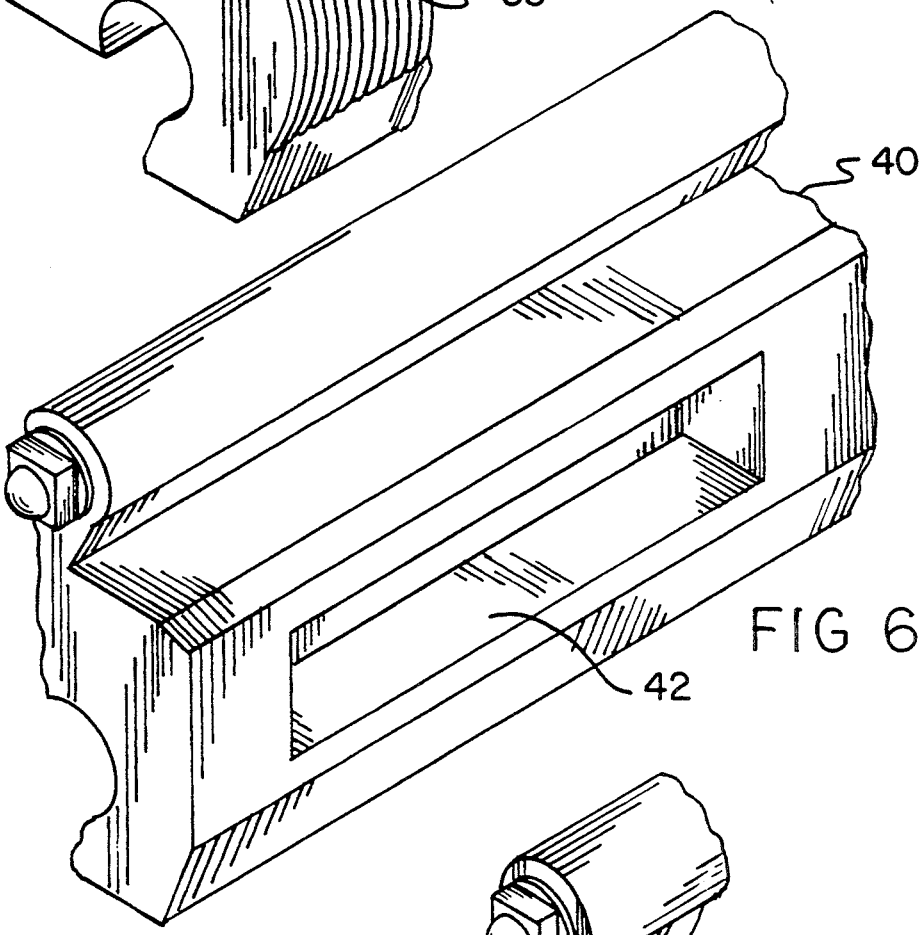

FIG. 6 is a perspective view of a lowermost segment of the device shown in the prior FIGS.

Figure 7:
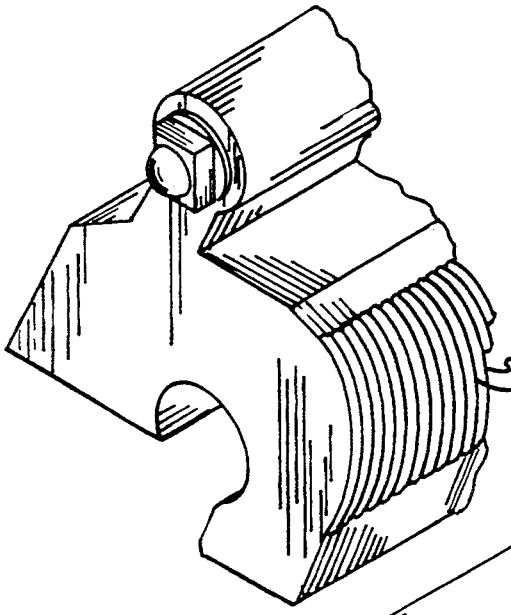

FIG. 7 is a perspective illustration with a decorator surface on one of the segments.

Figure 8:
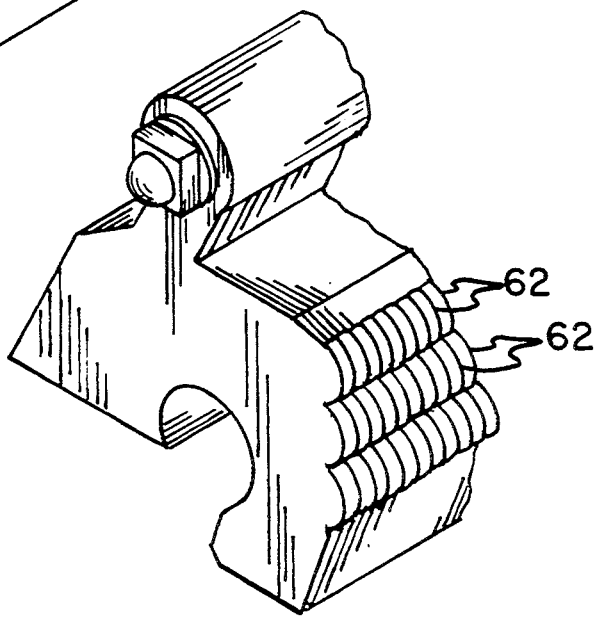

FIG. 8 is a perspective view of an alternate embodiment of the invention.

The same reference numerals refer to the same parts throughout the various Figures.

DESCRIPTION OF THE PREFERRED EMBODIMENT

With reference now to the drawings, and in particular to FIGS. 1 through 6 thereof, the preferred embodiment of the new and improved flexible closures formed of interlocking segments slidable between a closed operative orientation and an out of the way stored orientation embodying the principles and concepts of the present invention and generally designated by the reference numeral 10 will be described.

Specifically, it will be noted in the various FIGS. that there are provided flexible closures 10. In their broadest contexts, the closures 10 are formed of rails 12 and interlocking segments 14 slidable between a closed operative orientation and an out of the way stored orientation.

More specifically, the rails 12 are a pair of elongated members extending in parallel with each other. The rails are in a generally vertical orientation at their lower extents 18. It is between the lower extents 18 whereat the closures 10 will be positioned when in the closed operative orientation. The rails also include generally horizontal upper extents 20. The closures 14 are positioned between the rails at their upper extents 20 when in the upper stored orientation. Between the upper and lower extents are intermediate extents 22 which are curved and smoothly couple the upper and lower extents 20 and 18. The rails are provided with recesses 24 for providing support for the closure components as will be described hereinafter for their movement between their various orientations.

The next major part of the present invention is the plurality of closure components 14. The components when taken together constitute the closure. Each of the component segments 14 is located between the facing recesses 24 of the rails 12. They essentially fill the space between the rails at the lower extents 18 when in a closed operative orientation. They also essentially fill the space between the rails at the upper extents when in the inoperative storage orientation.

Each of the segments 14 has an upper portion 28. Each upper portion has a generally semi-circular cross-sectional configuration over the majority of its extent. It is provided with a circular aperture 30 extending therethrough with the axis of the upper portion and its aperture extending horizontally between opposed rails 18. Each of the segments 14 also has a lower portion 34. Each lower portion 34 is formed in the lower part thereof with a recess 36. The recess is of a generally semi-circular configuration over the majority of its extent. The axis of the lower portion is parallel with the axis of the upper portion 28.

In operation and use, the upper portion 28 of each segment, except for the topmost segment, is received within the recess 36 of the next adjacent portion 34. This allows for the flexing of adjacent segments 14 of the closure about the axes. This thereby forms the coupling between the adjacent segments of the entire closure.

The exterior surface of the lowermost segment 40 is provided with a recessed region 42. Note FIG. 6. The recessed portion constitutes a handle for use by an operator to open and close the closure.

The smooth rolling action of the various segments 14 within the rails 12 is effected by mechanisms extending outboardly of apertures 30 in the upper portions 28. In the FIG. 3 embodiment, a shaft 44 is press fit into each aperture 30. Its outboard end extends exteriorly thereof. The outboard end is formed with a recess 45 to receive a hard freely rotatable ball 46. A rigid keeper 47 is secured at its periphery to the surface of the upper portion 28 surrounding the apertures 30. A hole in the keeper allows the ball to extend therethrough to allow rolling contact of the ball within the rail 18 during raising or lowering of the segments with respect to the rail. A key 48 axially secured to the shaft 44 fits within a complementary keyway 49 extending radially from the aperture to preclude inadvertent rotation of the shaft 44 within the aperture 30 during operation and use.

Figure 1:
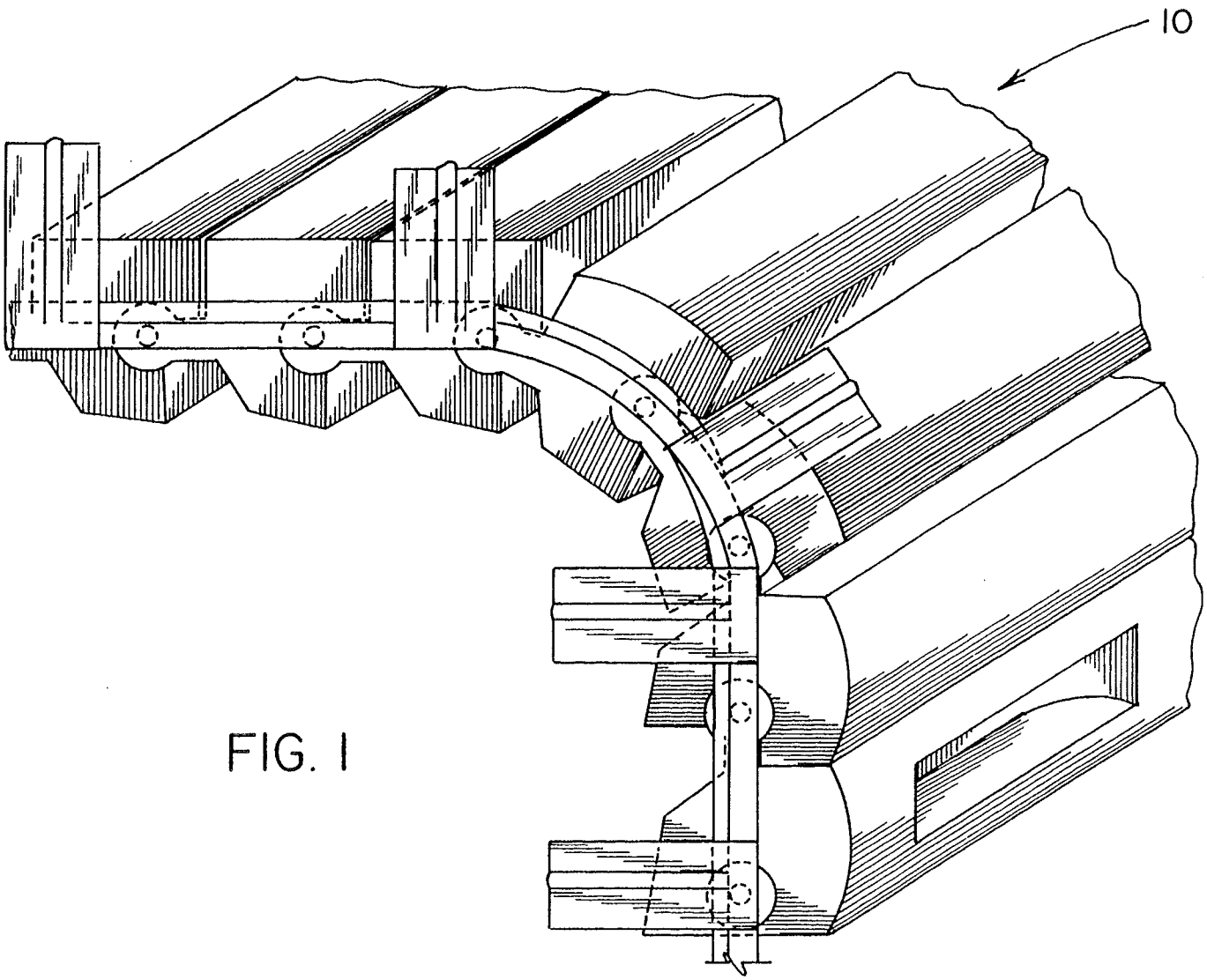
FIG. 1 is a perspective illustration of the preferred embodiment of the flexible closures formed of interlocking segments slidable between a closed operative orientation and an out of the way stored orientation constructed in accordance with the principles of the present invention.
Figure 3A:
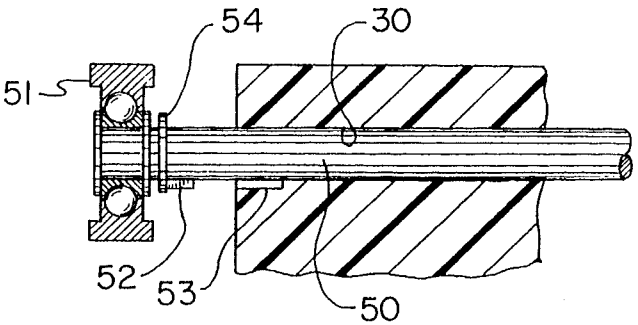
FIG. 3A is a cross sectional view similar to that of FIG. 3 but illustrating an alternate embodiment of the invention.
Figure 3:
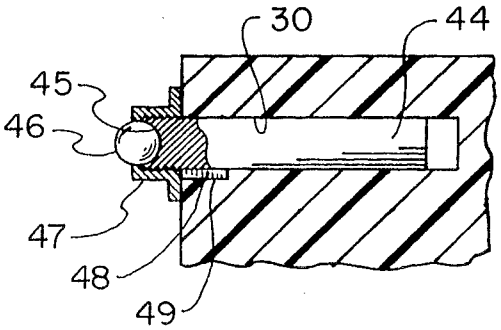
FIG. 3 is a cross-sectional view taken along line 3—3 of FIG. 2.
Figure 2:
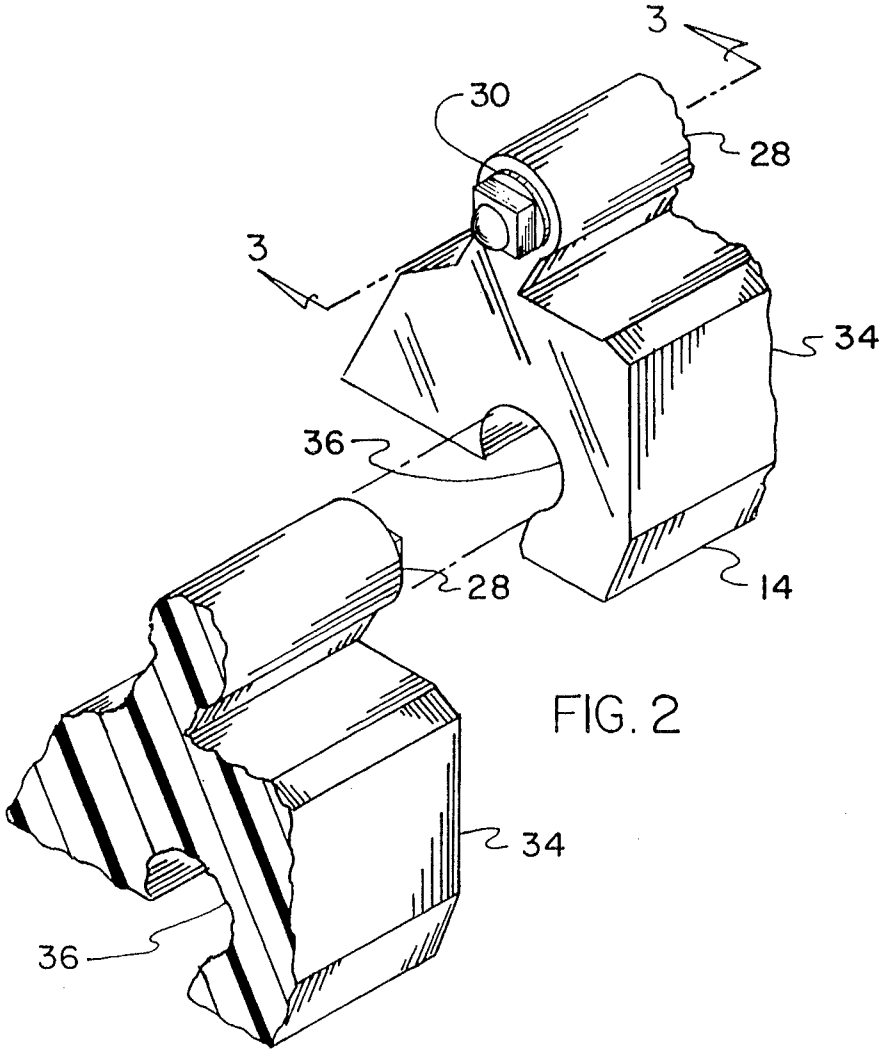
FIG. 2 is an exploded perspective view of a pair of mating segments from the device as shown in FIG. 1.

An alternate embodiment of the invention is shown in FIG. 3A. In such embodiment, shaft 50 is formed without a recess at its outboard end. A ball bearing assembly 51 is press fit onto the exposed outboard end of the shaft 50. A key 52 and complementary keyway 53 similar to that of the FIG. 3 embodiment preclude inadvertent rotational motion therebetween. In addition, a C-shaped collar limits the extent of penetration of the shaft 50 into the aperture. The FIG. 3A illustration shows the shaft 50 prior to full penetration. FIG. 3 shows the shaft 44 fully penetrated.

Another feature of the present invention is the use of rods 50 which extend across the entire widths of the closures. Note FIG. 3A. Such design is in contrast to short shafts 44 merely at the ends of the closures as shown in FIG. 3. The use of the elongated rods, preferably of steel, fully across the entire widths of the closures, in apertures 30 also extending the entire widths of the closures, are particularly suitable for security applications such as at malls for maximum protection against break-ins or the like.

In addition to the foregoing, Support braces 56 are provided. Such braces are located at space locations along the rails 18. They function to hold the rail in proper orientation with respect to each other and also with respect to the space to be opened and closed through the movement of the closure components 14.

FIGS. 7 and 8 illustrate alternate embodiments of the invention. In the FIG. 7 embodiment, recesses 58 extend generally perpendicular to the axes. Such recesses are formed on the exterior surface of each segment for decorative purposes. Such recesses are formed on all segments except for the lowermost segment where a handle portion 42 is located. An alternate decorative approach is shown in FIG. 8. In the FIG. 8 embodiment, the decorative surfaces include pluralities of decorative recesses 62 for aesthetic purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved flexible closure formed of interlocking segments slidable between a closed operative orientation and an out-of-the-way stored orientation comprising, in combination:

a pair of rails extending parallel with each other in a vertical orientation at their lower extents and extending generally horizontal at their upper extents with curved extents between the upper and lower extents, the rails being formed with facing guide recesses;

a plurality of segments which together constitute the closure, each of the segments located between the facing recesses of the rails to essentially fill the space between the rails at the lower extents when in a closed operative orientation and to essentially fill the space between the rails at the upper extents when in the inoperative storage orientation, each of the segments having an upper portion with a generally semi-circular cross-sectional configuration over the majority of its extent with the axis of the upper portion extending horizontally between the rails, each of the segments also having a lower portion within the lower part thereof with a recess being of a generally semi-circular configuration over the majority of its extent with its axis parallel with the axis of the upper portion, the upper portion of one segment being received within the recess of the lower portion of the next adjacent segment to thereby form coupling zones and thereby allow the flexing of the closure about the axes formed at the coupling zones between adjacent segments, each segment being located between its associated coupling zones, a recess formed in the exterior surface of the lowermost segment for constituting a handle to open and close the closure;

an aperture formed through each upper portion with a shaft extending therethrough with the ends of the shaft slidably recessed in the opposed recesses of the rails with a spherical bearing assembly in each end of each shaft coupling each rail with its associated upper portion; and recesses extending generally perpendicular to the axes formed on the exterior surfaces of the segment above the lowermost segment for decorative purposes.

* * * * *